United States Patent [19]

Stellaccio

[11] Patent Number: 4,743,194

[45] Date of Patent: May 10, 1988

[54] COOLING SYSTEM FOR GASIFIER BURNER OPERATING IN A HIGH PRESSURE ENVIRONMENT

[75] Inventor: Robert J. Stellaccio, Spring, Tex.

[73] Assignee: Texaco Inc., White Plains, N.Y.

[21] Appl. No.: 25,437

[22] Filed: Mar. 13, 1987

[51] Int. Cl.[4] ..... F23N 5/24; F23D 11/36

[52] U.S. Cl. ..... 431/23; 431/160; 239/132.3; 122/6.5

[58] Field of Search ..... 431/23, 160; 122/6.5, 122/6.6; 239/128, 132, 132.1, 132.3; 137/334, 335; 432/173

[56] References Cited

U.S. PATENT DOCUMENTS 2,963,353 12/1960 Eastman ..... 239/132.3 X
3,874,592 4/1975 Buschmann et al. ..... 239/132.3
4,666,463 5/1987 Stellaccio ..... 431/160 X

*Primary Examiner*—Margaret A. Focarino
*Attorney, Agent, or Firm*—Robert A. Kulason; James J. O'Loughlin; Robert B. Burns

[57] ABSTRACT

A burner for operating in a high temperature and high pressure atmosphere such as in a fuel burning gasifier, requires a high degree of cooling such as by water circulation through the burner. In the event of physical breakage or damage to the normal cooling system, means is provided for introducing a higher pressure coolant into the system. The latter fills the system, both upstream and downstream of the cooling coil, to permit progressive discontinuance of the burner operation without substantial damage. It further avoids the backflow of gas from the high pressure gasifier which would otherwise be discharged to flow back through the cooling system and be discharged into the atmosphere thereby creating a dangerous as well as a harmful environment.

6 Claims, 2 Drawing Sheets

FIG. 2
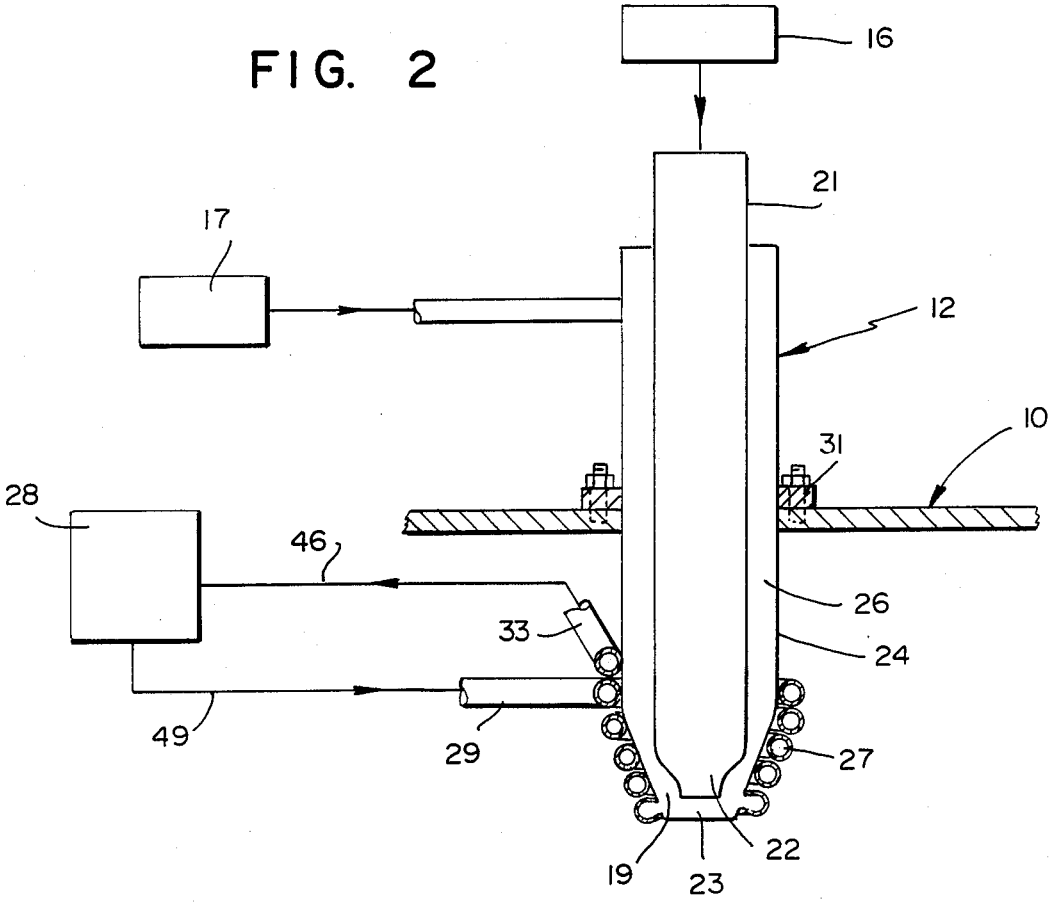
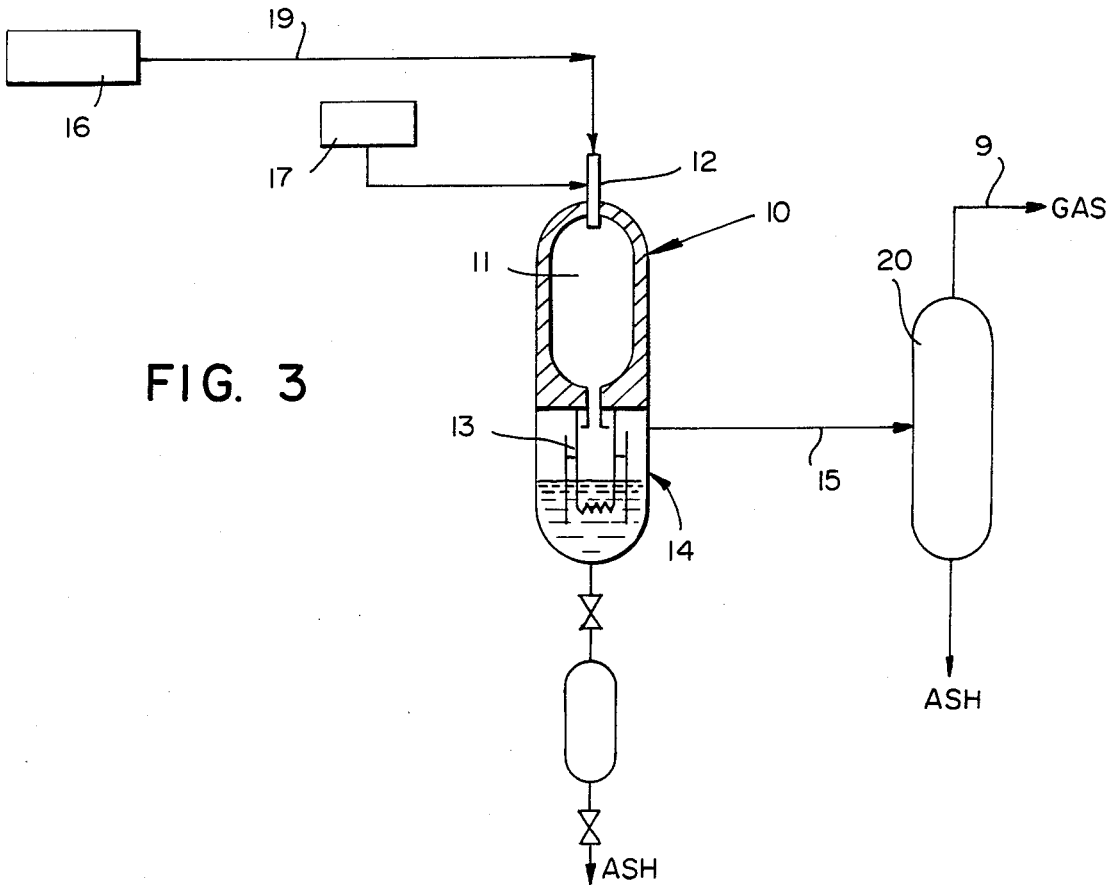
FIG. 3

COOLING SYSTEM FOR GASIFIER BURNER OPERATING IN A HIGH PRESSURE ENVIRONMENT

BACKGROUND OF THE INVENTION

Burners of the type hereinafter referred to are normally utilized in a gasifier unit wherein a synthetic gas is manufactured by partial oxidation of a fossil fuel at a relatively high pressure. The gasifier operating pressure of between about 350 psi and 1200 psi is normally maintained, at a temperature between 1700° F. and 3100° F. Thus, the burner which is positioned within the gasifier combustion chamber is subjected to harsh operating conditions.

Operationally, one embodiment of such a gasification system comprises a gasifier having a combustion chamber into which a coal or coke fuel mixture or slurry is injected. The injection member comprises a burner which receives and mixes flows of particulated fuel, and an oxidizing gas. The mixture is then forcibly injected into the combustion chamber to overcome the high pressure generated in the latter.

Unless the burner, which partially intrudes into the gasifier combustion chamber, is provided with adequate cooling, it will soon become damaged or even inoperative.

It is customary therefore to provide gasifier burners with a cooling system that protects the burner external exposed surfaces. A cooling system found to suit this purpose would comprise a series of coils which encircle and contact the lower or discharge portion of the burner. A coolant, preferably water, is circulated through this coil system at a sufficient pressure and rate to maintain the burner tip at a reasonable operating temperature.

When adequate cooling is achieved, the burner's function will not be adversely affected, nor will it suffer thermal damage.

The cooling coils are usually formed of steel, and are close fitting about the burner's outer surface. These cooling coils, are communicated with a pressurized source of the coolant. Thus, water flow through the cooling system can be regulated to maintain a desired burner tip temperature.

Since the cooling coils are of necessity positioned within the gasifier combustion chamber, any damage to the coils in the form of a pin hole, crack, or break, will discharge water into the gasifier combustion chamber.

In such an instance, unless the gasifier operation is immediately discontinued, a probability exists that the burner and even the gasifier could be damaged to the point where either will become unusable.

Usual damage to the cooling system could consist of a minor crack within the cooling coils or around the burner surface exposed to the hot combustion gases. It can, however, consist of a major break or rupture in either the coils or the burner. In one instance, the coolant water will be discharged into the gasifier at a relatively minor rate with minimal effect. The break will thus not be readily detected. Where a major break occurs however, a large amount of water will be discharged into the gasifier.

It is desirable in any instance, that the temperature and flow of water through the cooling system be constantly monitored. This function is necessary if one is to promptly detect any form of break or water leakage.

If compensating steps are taken promptly, after a break does occur, the gasifier operation can be controllably discontinued and the burner protected from severe damage. However, under certain circumstances interruption of minor coolant flow might not be detected. The burner operation will therefore continue, and the gasifier will operate until the coolant leak has become so severe as to result in excessive damage.

In the presently disclosed arrangement, a unique burner cooling system is provided which operates in two phases or modes. In the first phase, a high pressure flow of water is circulated through a cooling element to the burner tip. Concurrently, conditions of the coolant flow are monitored by a continuous sensing of the pressure differential which occurs between the coolant stream, and a standard pressure point exterior to the gasifier.

When it becomes apparent through monitoring of the system that a break has occurred in the cooling element, the second phase or mode of the system is selectively actuated. The latter functions to inject a second source of high pressure coolant water into the cooling system. This step will preclude the possible back flow of high pressure gas from the gasifier combustion chamber, through cooling system piping.

It is therefore an object of the invention to provide a burner cooling system which embodies a relatively fail safe operation.

A further object of the invention is to provide a burner cooling system in a high pressure gasifier unit which will be automatically actuated to adjust cooling water flow to avoid damage to the burner when the coolant system has become flawed through leakage.

A still further object of the invention is to provide a cooling system for a burner operating in a high pressure atmosphere, such system including a first phase that normally functions at a sufficiently high pressure and flow rate to cool the burner, and a second or emergency phase which is automatically actuated to supplement the first phase flow of cooling liquid whereby to avoid leakage of gas from the gasifier into the atmosphere.

DESCRIPTION OF THE DRAWINGS

FIG. 2 is an elevation view in cross-section of a burner presently contemplated.

FIG. 3 is a diagrammatic representation of a gasification process in which the burner would find use.

Referring to FIG. 3, a typical embodiment of one type of apparatus capable of producing a usable synthetic gas by a coal gasification process is shown. This system comprises primarily a vertically positioned gasifier 10. The latter incorporates a reaction or combustion chamber 11 into which a fuel mixture is introduced under pressure by a water cooled burner 12, and is partially oxidized. This combustible fuel mixture normally is comprised of gas, liquids, or solids such as pulverized coal or coke together with an oxidant fluid such as air, oxygen or mixtures thereof and a moderator such as steam, water, or recycled synthesis gas.

Figure 1:
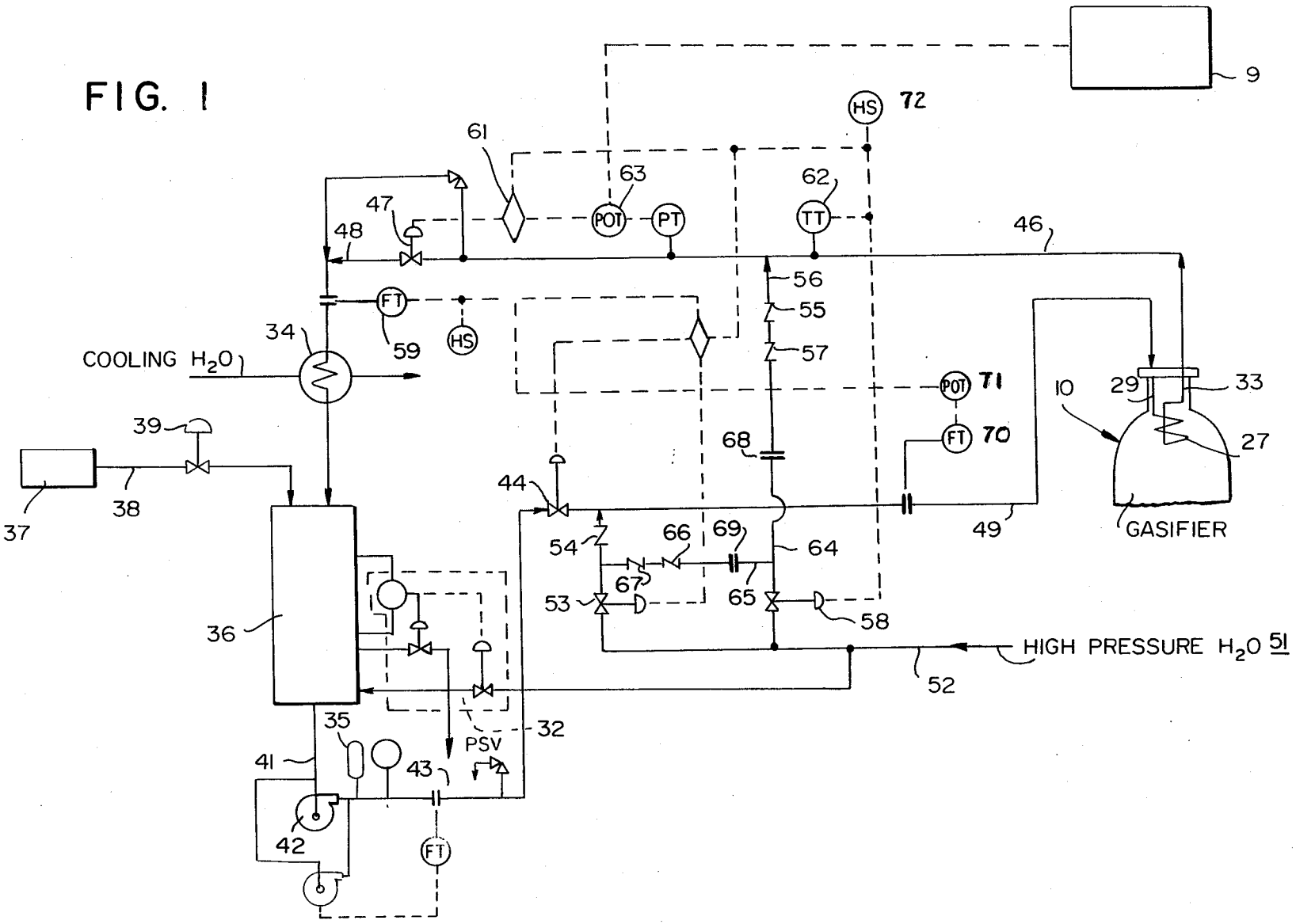
FIG. 1 is a diagrammatic representation of the disclosed burner cooling system.

Due to the normally high temperature and pressure at which the fuel mixture is burned, usually within a range of 1700° to about 3100° F., combustion chamber 11 is provided along its inner wall with a liner of a refractory material.

The lower end of combustion chamber 11 is communicated to an intermediate dip tube 13 of the gasifier 10, through which the produced gas, carrying ash particles is swirled and contacted with quench water. A quench chamber 14 positioned beneath chamber 11 holds a pool of coolant water. The latter normally receives heavier solid components of the partial combustion in the form of large slag and ash particles.

Quench chamber 14 as noted is contained within the pressurized gasifier 10 shell and is further provided with at least one nozzle or injector through which quench water enters. The water serves to cool raw synthesis gas and to maintain the coolant pool at a desired level within said chamber.

The upstream segment of the disclosed gasification apparatus is comprised of a source 16 of gaseous oxidant which is combined with the fuel stream at burner 12 by line 18. The fuel can be any one of several hydrocarbon types such as gaseous fuels, liquid fuel or solids such as coal or coke in slurry form.

A conductor 15 communicated with quench chamber 14 carries a stream of produced gas together with a minor amount of fine ash from the gasification process. This gaseous stream is delivered to a scrubber 20 so that the ash can be separated from the gas, and the latter delivered through line 9 as raw synthesis gas product.

The fuel mixture from source 17, is delivered to combustion chamber 11 from the tip end of burner 12.

In one embodiment, burner 12 as shown in FIG. 2, is comprised of concentrically positioned tubular members which define a series of annular passages therebetween. In a relatively simplified embodiment, burner 12 is comprised primarily of a central tubular member 21 which is constricted at the lower end and is communicated with the pressurized source of oxygen 16. A stream of the latter is carried through said member 21 and delivered from the burner discharge end 22, into combustion chamber 11 by way of mixing compartment 23.

A second or outer tubular member 24 is fixedly positioned concentric with the inner tubular member 21 and extends the length thereof. A constricted section at the lower end defines an inwardly tapered annular discharge port 19.

Outer member 24 defines an annular passage 26 into which a fuel, for the present purposes, a fuel slurry, is pumped from source 17 by way of conduit 25. The fuel is thereby caused to flow longitudinally through annular passage 26 and be discharged at the nozzle 19. There it will mix with the inner stream of combustion supporting gas discharged from 22.

As shown, burner 12 is removably positioned within a wall of gasifier 10. Normally the burner embodies a flange 31 or similar mounting piece which engages a corresponding mounting member at the roof of the gasifier 10 shell. Thus, when fixed in place, the lower end of burner 12 will be suspended in the gasifier combustion chamber for at least part of its length.

The lower end of burner 12 is provided with a cooling element 27 which in one form can comprise a series of coils, a manifold, or similar structure capable of conducting a stream of a coolant medium such as water. The cooling element 27, hereinafter referred to as a cooling coil, is disposed outwardly of the lower end of the burner discharge end 19, preferably in contact with the external wall of the latter and provides water to the cooling channel 32 which protects the burner tip.

The respective coil sections 27 comprise a continuous unit and can be fastened in place or merely positioned in a manner to engage a wall of the burner. As here shown, the inlet end 29 of cooling coil 27 is communicated with a pressurized source of water generally identified as cooling system 28.

The pressurized water will preferably be at a temperature of about 100° F. as it enters coil 27. The exit side of said coil is likewise communicated with the cooling system 28; the latter connection being preferably through a heat exchanger which is not shown. Thus, the temperature of the water can be reduced from about 125° F. before it is recirculated through the burner cooling system.

As noted herein, cooling coil 27 and the burner tip are subjected to the harshest environmental conditions within combustion chamber 11 from both the external temperature and the internal pressure of the coolant water stream. The occasion would arise therefore, when coil 27, or the cooled burner tip, develops a small crack. It could even be fractured to the extent that it develops a major break in at least one part thereof. On such a happening, while a substantial amount of the water might continue to circulate through coil 27, at least some of it will emerge through the crack and enter the hot combustion chamber 11.

The effect of such leakage can be detected by any one of several means such as a thermocouple positioned to measure water temperature at a point downstream of the cooling water cycle. Thus, when said temperature rises, it will indicate that the normal flow of water has been interrupted as by a leak or other malfunction in the cooling coil 27 and/or cooling channel 32.

Toward overcoming or precluding the possibility of damage to burner 12 as a result of a defect occurring in cooling coil 27 or the cooling channel 32, the present dual phase water system 28 is provided. The system functions to automatically and selectively communicate burner cooling coil 27 with multiple sources of cooling water.

Cooling system 28 as shown schematically in FIG. 1 is comprised of a tank or reservoir 36 which stores a pressurized supply of cooling water. Tank 36 is communicated with a source of water 51 through a suitable level control including means for continuously sensing the level of the water in the tank, and for operating control means to replenish or regulate the supply of water from source 51 or from an alternate pressurized source. Tank 36 can be further communicated with a source of pressurizing gas 37 by way of line 38 and control valve 39 whereby the water pressure within tank 36 can be regulated.

The lower end of the tank 36 is communicated by line 41 to the inlet of a circulating fixed rate pump 42. The pump discharge is communicated through pulsation dampener 35 and line 43 to remotely actuated flow block valve 44 which stops water flow from pump 42 under emergency conditions. Valve 44 is in turn communicated through line 49 with the inlet 29 of cooling coil 27.

Cooling coil 27 outlet 33 discharges a heated water stream through line 46 into pressure control valve 47. The latter functions to be remotely and automatically adjusted to regulate back pressure within the circulating cooling system. The downstream side of valve 47 is communicated through line 48 to the inlet of heat exchanger 34. The outlet of said heat exchanger is communicated to tank 36 thereby completing the primary cooling circuit or first cooling phase.

Under non-leak or rupture conditions, the system will operate in the first cooling phase or mode. Water from tank 36 will be passed through pump 42 at a predetermined rate. Thus, the flow of coolant through the burner cooling coil 27 will be adequate to maintain the burner temperature at a safe operating level.

A substitute high pressure water supply 51 is used to provide cooling water through line 52 in the event pump 42 fails. Low water flow detected by flow sensor 59 will close valve 44 and open valve 53 to trigger the alternate water supply 51 to provide the cooling water flow should pump 42 or its spare fail to operate properly in providing needed water flow. Alternately this substitute water supply can be activated by manual switch 73.

Cooling coil outlet 33 discharges a heated water stream into pressure control valve 47. The latter functions to be remotely and automatically adjusted whereby to regulate the pressure within the cooling system depending on gasifier pressure. The downstream side of said valve 47 as noted, is communicated to the inlet of heat exchanger 34, the outlet of which is communicated to tank 36 thereby discharging water for recirculation.

A pressure differential detector 63 is initially set to maintain a desired pressure differential between downstream cooling water at pressure sensor 72, and a point external to the gasifier. For example, a pressure differential of about 125 psi could be established as described between coolant flow and the head of scrubber 9 which receives pressurized synthesis gas from the gasifier.

Upon the occurrence of a defect in the cooling system, particularly at coil 27, the second phase of the system will be automatically activated in response to any of several factors. Such factors include the rise in temperature of downstream cooling water or a change in pressure differential. The supplementary or second phase cooling circuit as noted is comprised primarily of the pressurized source of secondary water 51 which is at a pressure in excess of water pressure downstream of pump 42.

Said secondary source 51 can originate as boiler feed water at about 1450 psi and 250° F., or at a similar source. This elevated pressure water is thus conducted through line 52 to remotely actuated blocking valve 58. The latter is in turn communicated with lines 64 and 65 to effect a split flow as determined by preset sizes of restriction orifices 68 and 69. Water flow as determined by restriction orifice 69 is communicated through check valves 66, 67 and into check valve 54 downstream from block valve 53. Block valve 53 is in the blocked position in this second phase cooling circuit. Block valve 44 is also closed during this second phase to assure that all water flows toward cooling coil 27.

Thus, in the emergency mode, secondary water is introduced to line 49 and carried directly to the cooling coil 27 inlet at the elevated pressure of source 51. Concurrently, high pressure water passes through check valves 57 and 54, to enter line 46 and apply the same high pressure to cooling coil outlet 33.

Operationally, detection of a leak in the cooling system will be sensed by either a temperature increase at temperature sensor 62, or by a difference in flow between flow detectors 59 and 70 as indicated by differential flow detector 71. In the event of a leak, water pressure and flow in line 46 on the exit side of the cooling coil will decrease. The lower pressure will cause differential pressure control valve 47 to start closing off in an effort to maintain the pressure in the line. If sufficient leakage occurs the valve will completely close.

Because of a lower water flow through the burner tip due to a leak, the water will heat to a temperature greater than normal. This will be detected from temperature sensor 62. Such detection will activate the emergency system through interlock 61 which will act to close valve 47. Thus, water is directed toward the exit side of coil 27.

Temperature sensor 62 will also close valves 44 and 53 and open valve 58 so that emergency water from 51 flows toward coil 27 at regulated flow rates basis restriction orifices 68 and 69. Restriction orifices 68 and 69 regulate flow so that excessive water will not enter the hot gasifier 10 and cause damage.

Should temperature sensor 62 not detect a high temperature then differential flow detector 71 provides, a backup method for leak detection since a leak will cause a low flow at flow detector 59 compared to the inlet flow at detector 70. Should a differential flow be detected a manual switch 72 can be used to activate the emergency cooling water system to provide the same actions previously described.

It is understood that although modifications and variations of the invention can be made without departing from the spirit and scope thereof, only such limitations should be imposed as are indicated in the appended claims.

I claim:

1. Multi-phase cooling system for a burner used in a high pressure reactor having a combustion chamber, wherein said burner is positioned in said combustion chamber to deliver a stream of fuel thereto, and said burner includes a cooling element which circulates a liquid coolant from a pressurized source thereof, disposed in heat exchange contact with the burner, a first cooling circuit communicated with said cooling element to circulate a high pressure stream of the liquid coolant therethrough from said high pressure source thereof during operation of the high pressure reactor, a second cooling circuit communicated with said burner cooling element and being selectively actuated to introduce a second liquid coolant stream from a second high pressure source thereof into said cooling element at a pressure in excess of the operating pressure within said reactor combustion chamber, flow control valve means communicating said first and second cooling circuits respectively with said cooling element, said flow control valve means being selectively actuatable to discontinue flow of coolant liquid from said first cooling circuit to said burner cooling element, and to concurrently communicate said second cooling circuit with said cooling element at such time as the latter becomes sufficiently defective as to leak coolant liquid into said combustion chamber.

2. In the apparatus as defined in claim 1, including; sensor means positioned downstream of said burner cooling element to sense the liquid coolant condition which indicates a change in coolant flow, said sensor means being in actuating control of said flow control valve means to actuate the second cooling circuit in response to said change in condition of the liquid coolant.

3. In the apparatus as defined in claim 1, wherein said coolant pressure in said first cooling circuit downstream side of said burner cooling element is greater than the operating pressure within said high pressure reactor.

4. In the apparatus as defined in claim 3, wherein the pressure in said high pressure reactor is normally within the range of about 350 to 1200 psia.

5. In the apparatus as defined in claim 1 wherein said second cooling circuit, when selectively communicated by said valve means with the burner cooling element will exert substantially equal pressure on the respective upstream and downstream sides of the cooling element.

6. In the apparatus as defined in claim 2, wherein said sensor is communicated with said reactor and with a gas scrubber to monitor the pressure at said respective points.

* * * * *